US006443714B1

(12) United States Patent
Hollenbeck et al.

(10) Patent No.: US 6,443,714 B1
(45) Date of Patent: Sep. 3, 2002

(54) METHODS AND APPARATUS FOR PREVENTING MOISTURE IN FAN MOTOR HOUSINGS

(75) Inventors: Robert Keith Hollenbeck; James Everett Grimm, both of Fort Wayne, IN (US)

(73) Assignee: General Electric Company, Schenectady, NY (US)

( * ) Notice: Subject to any disclaimer, the term of this patent is extended or adjusted under 35 U.S.C. 154(b) by 2 days.

(21) Appl. No.: 09/596,992

(22) Filed: Jun. 20, 2000

Related U.S. Application Data

(60) Provisional application No. 60/173,160, filed on Dec. 27, 1999.

(51) Int. Cl.[7] ..... F04B 17/00

(52) U.S. Cl. ..... 417/423.1; 417/423.14; 417/423; 417/53

(58) Field of Search ..... 417/423.1, 423.14, 417/423.7, 53

(56) References Cited

U.S. PATENT DOCUMENTS

| | | | | |
|---|---|---|---|---|
| 1,620,875 A | | 3/1927 | Currie | |
| 2,680,559 A | | 6/1954 | Morrill | |
| 4,193,740 A | | 3/1980 | Charles | |
| 4,325,650 A | | 4/1982 | Masai | |
| 4,370,074 A | | 1/1983 | Masai | |
| 4,619,586 A | | 10/1986 | Carter | |
| 4,626,720 A | * | 12/1986 | Fukasaku et al. | 310/62 |
| 4,633,769 A | | 1/1987 | Milks | |
| 4,750,860 A | | 6/1988 | Kelley | |
| 4,805,868 A | | 2/1989 | Calude | |
| 4,900,957 A | | 2/1990 | Barker et al. | |
| 5,186,605 A | | 2/1993 | Tracy | |
| 5,208,730 A | | 5/1993 | Tracy | |
| 5,271,717 A | | 12/1993 | Sato | |
| 5,297,936 A | | 3/1994 | Sato | |
| 5,393,961 A | * | 2/1995 | Umekage et al. | 219/57 |
| 5,460,485 A | | 10/1995 | Sugiyama et al. | |
| 5,507,619 A | | 4/1996 | Ryan | |
| 5,526,228 A | | 6/1996 | Dickson et al. | |
| 5,530,304 A | | 6/1996 | Mirumachi et al. | |
| 5,540,551 A | | 7/1996 | Heinig | |
| 5,558,298 A | | 9/1996 | Pla et al. | |
| 5,562,421 A | | 10/1996 | Huang | |
| 5,582,507 A | | 12/1996 | Alizadeh | |
| 5,586,871 A | | 12/1996 | Barnes et al. | |
| D380,539 S | * | 7/1997 | Liu | D23/377 |
| 5,767,596 A | * | 6/1998 | Stark et al. | 310/89 |
| 5,868,189 A | | 2/1999 | Jarvis | |
| D426,296 S | * | 6/2000 | Blateri | D23/382 |
| 6,142,733 A | | 11/2000 | Alizadeh et al. | |
| 6,193,478 B1 | | 2/2001 | Lin et al. | |
| 6,279,866 B1 | | 8/2001 | Eilemann et al. | |

FOREIGN PATENT DOCUMENTS

| | | |
|---|---|---|
| DE | 19518489 | * 11/1996 |
| JP | 4-29540 | * 1/1992 |
| JP | 2001-304189 | * 10/2001 |

* cited by examiner

*Primary Examiner*—Charles G. Freay
*Assistant Examiner*—Michael K. Gray
(74) *Attorney, Agent, or Firm*—Karl Vick, Esq.; Armstrong Teasdale LLP

(57) ABSTRACT

A fan assembly includes a shroud attached to a motor housing to prevent negative pressure from developing within the motor housing and prevent moisture from being drawn into drain openings. The assembly includes a fan, a motor, a motor housing, and a fan control. The motor and fan control are disposed within the motor housing. The motor housing includes drain openings to permit the motor housing to be assembled and to permit moisture to drain to the environment from the motor housing. The shroud is attached downstream from the fan such that the drain openings remain open to the environment.

22 Claims, 2 Drawing Sheets

METHODS AND APPARATUS FOR PREVENTING MOISTURE IN FAN MOTOR HOUSINGS

CROSS REFERENCE TO RELATED APPLICATION

This application claims the benefit of U.S. Provisional Application No. 60/173,160, filed Dec. 27, 1999.

BACKGROUND OF THE INVENTION

This application relates generally to fans and, more particularly, to fan shrouds for use with fans.

Fan assemblies typically include a fan, a motor, a fan control, and a motor housing. The fan motor and control are positioned within the motor housing and control the energization and rotation of the fan. Because the fan assemblies are often used in applications in which condensation and moisture accumulate, the fan control sometimes fails as a result of exposure to moisture.

To prevent such failures, typically the fan control is covered with a moisture resistant potting material and the motor housing is fabricated with drain holes. However, as air flows over such drain holes, a negative pressure develops within the motor housing that causes air and moisture to be drawn into the motor housing from the environment. Over time, continued exposure to the moisture and airflow causes the potting material to erode, allowing the moisture to contact the fan and motor control. As a result, frequent maintenance is scheduled to prevent such fan assemblies from failing.

BRIEF SUMMARY OF THE INVENTION

In an exemplary embodiment, a fan assembly includes a shroud attached to a motor housing to prevent negative pressure from developing within the motor housing and thus, prevent moisture from being drawn into drain openings. The fan assembly includes a fan, a motor, a motor housing, and a fan control. The motor and fan control are disposed within the motor housing and the fan extends from an upstream portion of the motor housing. The motor housing includes a plurality of drain openings that permit moisture to drain to the environment from the motor housing. The shroud is attached downstream from the fan to the motor housing and is attached co-axially to the motor housing such that the drain openings remain open to the environment.

During operation, air exiting the fan passes over the shroud and is directed downstream. The shroud prevents negative pressure from developing within the motor housing and thus, prevents any moisture from being drawn into the motor housing through the motor housing openings. Additionally, any condensation that develops within the motor housing is permitted to drain through the motor housing drain openings. As a result, a fan assembly is provided that is reliable and cost-effective.

DETAILED DESCRIPTION OF THE INVENTION

Figure 1:
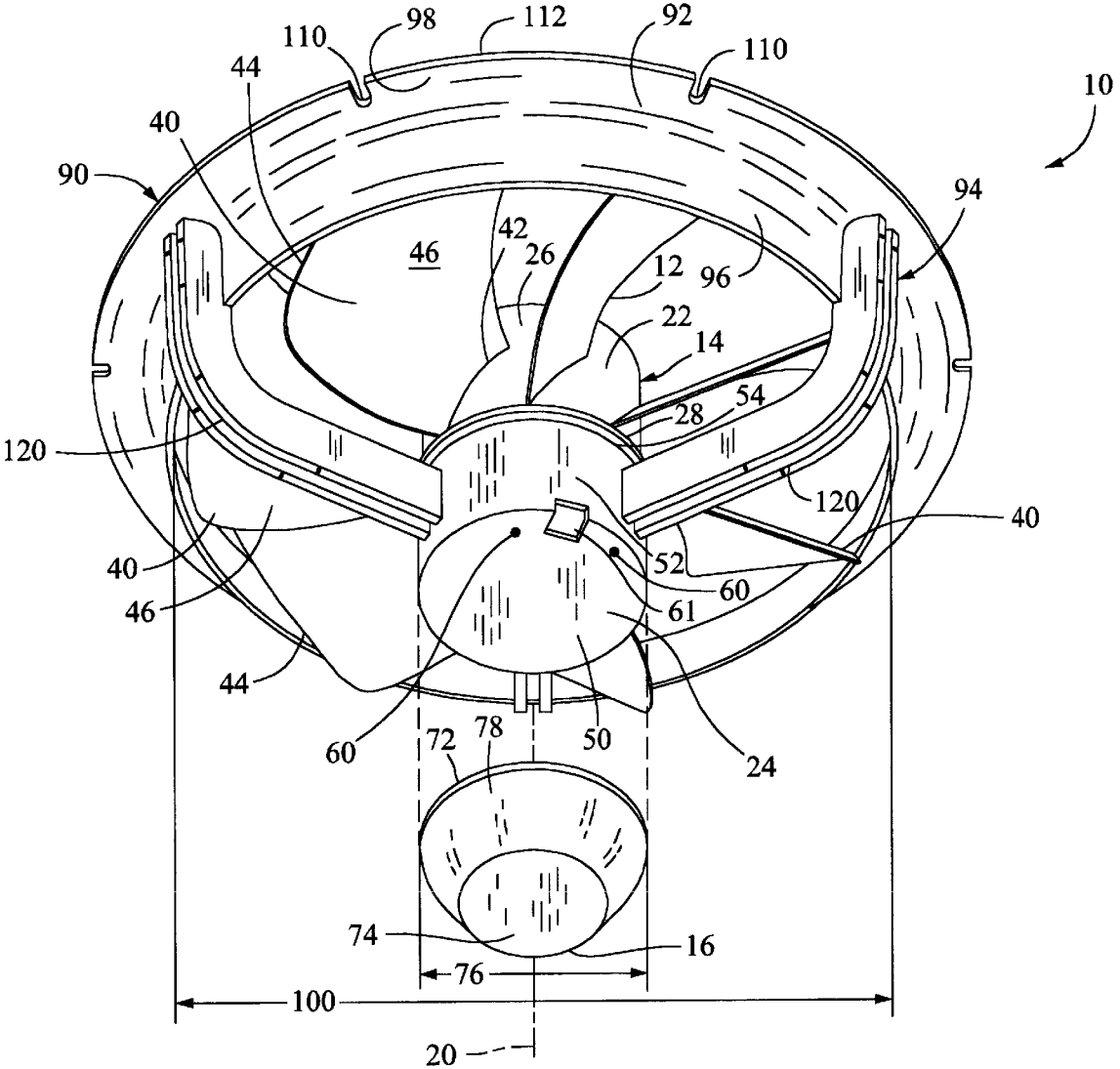
FIG. 1 is an exploded perspective view of a fan assembly including a shroud.
Figure 2:
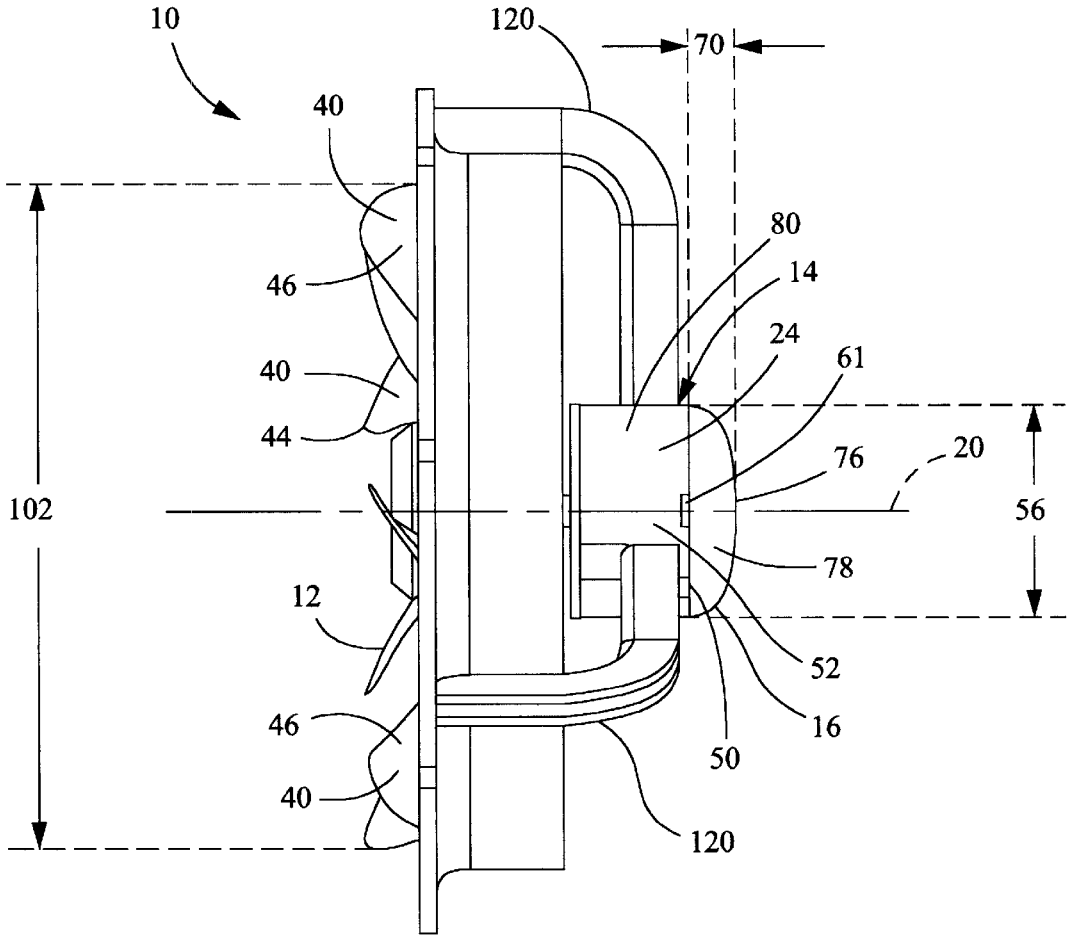
FIG. 2 is a side elevational view of the assembled fan assembly shown in FIG. 1.

FIG. 1 is an exploded perspective view of a fan assembly 10 and FIG. 2 is a side elevational view of assembled fan assembly 10. Fan assembly 10 includes a motor (not shown), a fan 12, a motor housing 14, and a shroud 16. The motor and fan control are disposed within motor housing 14 and control energization and rotation of fan 12 about an axis of rotation 20.

Motor housing 14 includes a rotating first body 22 and a stationary second body 24. Rotating first body 22 is substantially cylindrical and includes a top (not shown), a side wall 26, and a bottom flange 28. Side wall 26 extends substantially perpendicularly from the top to bottom flange 28. Rotating first body 22 has a diameter (not shown) measured with respect to side wall 26 that is constant from the top to bottom flange 28. Bottom flange 28 extends radially outward from side wall 26 and has a diameter (not shown) larger than the diameter of rotating first body 22 measured with respect to side wall 26. Bottom flange 28 permits rotating first body 22 to be in sealable and rotating contact with stationary second body 24.

Fan 12 extends from rotating first body 22 and includes a plurality of fan blades 40 extending outward from rotating first body 22. Each fan blade 40 includes a root 42 attached to rotating first body 22, a tip 44, and a body 46 extending between fan root 42 and fan tip 44.

Motor housing stationary second body 24 is substantially cylindrical and includes a bottom 50, a side wall 52, and a top flange 54. Bottom 50 is substantially flat and side wall 52 extends substantially perpendicularly from bottom 50 to top flange 54. Stationary second body 24 has a diameter 56 measured with respect to side wall 52 that is constant from bottom 50 to top flange 54. Top flange 54 extends radially outward from side wall 52 and has a diameter (not shown) larger than stationary second body diameter 56 measured with respect to side wall 52. Top flange 54 is sized to permit stationary second body 24 to rotatably attach to rotating first body 22.

Stationary second body 24 includes a plurality of openings 60 extending through stationary second body bottom 50 and a snap fit (not shown). Openings 60 permit moisture to drain from motor housing 14 to the environment. The snap fit extends circumferentially around an inner surface (not shown) of stationary second body 24 and permits motor housing rotating first body 22 to snap-fit to motor housing stationary second body 24. A connector interface opening 61 is also disposed within stationary second body 24.

Shroud 16 has a height 70 between a top edge 72 of shroud 16 and a bottom 74 of shroud 16. Shroud bottom 74 extends circumferentially and curves to top edge 72. A diameter 76 of shroud 16 measured with respect to top edge 72 is approximately the same size as motor housing stationary second body diameter 56. Accordingly, when shroud 16 is attached co-axially with motor housing 14, a shroud outer surface 78 is substantially co-planar with an outer surface 80 of motor housing stationary second body 24 while shroud bottom 74 and top edge 72 are substantially perpendicular to motor housing stationary second body side wall 52. Additionally, when shroud 16 is attached to motor housing 14, openings 60 remain open to the environment to permit moisture and condensation to drain from motor housing 14.

A fan orifice 90 extends from motor housing 14 and permits fan assembly 10 to mount within a component (not shown) without fan assembly 10 contacting the component. In one embodiment, the component is a refrigerator assembly. Fan orifice 90 includes a ring shroud portion 92 and a support portion 94. Ring shroud portion 92 is generally circular and includes a cylindrical portion 96 and a flange 98. Cylindrical portion 96 extends substantially perpendicularly from flange 98 and has a diameter 100 larger than a diameter 102 of fan 12. Flange 98 is substantially flat and includes a plurality of slots 110 extending circumferentially inward from an outer edge 112 of flange 98. Slots 110 provide openings for fasteners (not shown) to secure fan assembly 10 within the component.

Fan orifice support portion 94 includes a plurality of legs 120 extending between ring shroud portion flange 98 and motor housing stationary second body 24. In one embodiment, fan orifice support portion 94 includes three legs 120 spaced circumferentially around ring shroud portion flange 98 and motor stationary second body 24. Support legs 120 extend substantially perpendicularly from fan orifice support portion 94 and bend to attach substantially perpendicularly to motor housing stationary second body 24. Support portion 94 secures fan orifice 90 to motor housing 14.

In operation, shroud 16 is attached to motor housing bottom flange 28 such that shroud 16 is substantially co-axial with motor housing 14. As fan 12 rotates, fan blades 40 rotate simultaneously with motor housing rotating first body 22. Air is drawn into fan orifice 90 through fan 12 and expelled axially outward to pass over motor housing stationary second body 24. Without shroud 16 attached to motor housing bottom flange 28, a negative pressure develops within motor housing 14 and moisture and air are drawn through openings 60 and connector interface opening 61 into motor housing 14. When shroud 16 is attached to motor housing bottom flange 28, shroud 16 prevents negative pressure from developing within motor housing 14. Instead, shroud 16 directs the air downstream and prevents air and moisture from being drawn through openings 60 and connector interface opening 61.

The above described fan assembly is cost effective and reliable. The fan assembly includes a shroud attached to a motor housing downstream from the fan. The motor housing includes a plurality of openings that permit moisture to drain from the motor housing to the environment. The shroud attaches co-axially to the motor housing such that the openings are remain open to the environment. When attached, the shroud prevents negative pressure from developing within the motor housing as the fan operates and thus, moisture and air are not drawn into the motor housing. As a result, the fan assembly provided is more reliable and cost-effective than known fan assemblies.

While the invention has been described in terms of various specific embodiments, those skilled in the art will recognize that the invention can be practiced with modification within the spirit and scope of the claims.

What is claimed is:

1. A method for preventing moisture from entering a fan motor assembly using a shroud, the fan motor assembly including a fan, a motor housing, and a motor disposed within the motor housing, the motor configured to control rotation of the fan about an axis of rotation, the motor housing including a rotating portion and a stationary portion, said method comprising the steps of:

attaching the shroud against the motor housing stationary portion wherein the shroud facilitates preventing a negative pressure from developing within the motor housing; and operating the fan.

2. A method in accordance with claim 1 wherein the motor housing includes a plurality of openings to permit moisture to drain to the environment, said step of attaching the shroud further comprising the step of attaching the shroud such that the fan motor housing openings remain open to the environment.

3. A method in accordance with claim 2 wherein the motor housing has an outer diameter approximately the same size as an outer diameter of the shroud, said step of attaching the shroud further comprising the step of attaching the shroud such that the shroud is co-axial with the motor housing.

4. A method in accordance with claim 3 wherein the fan is an axial flow fan, said step of attaching the shroud further comprising the step of attaching the shroud to the motor housing downstream of the fan.

5. A fan assembly comprising:

a fan comprising a plurality of blades;

a motor for controlling rotation of said fan about an axis of rotation;

a motor housing comprising a rotating portion and a stationary portion, said motor disposed within said motor housing; and a shroud attached to said motor housing and configured to facilitate preventing a negative pressure from developing within said motor housing to prevent moisture from entering said motor housing.

6. A fan assembly in accordance with claim 5 wherein said motor housing comprises a plurality of openings to permit moisture to drain to the environment, said shroud attached to said motor housing such that said plurality of openings remain open to the environment.

7. A fan assembly in accordance with claim 5 wherein said motor housing comprises an outer diameter, said shroud comprises an outer diameter, said motor housing outer diameter approximately equal said shroud outer diameter.

8. A fan assembly in accordance with claim 5 wherein said fan shroud mounts substantially co-axially with said motor housing.

9. A fan assembly in accordance with claim 5 wherein said shroud is positioned symmetrically about the fan axis of rotation.

10. A fan assembly in accordance with claim 5 wherein said fan is an axial flow fan.

11. A fan assembly in accordance with claim 5 wherein said fan shroud is downstream from said fan.

12. A fan assembly in accordance with claim 5 wherein said fan blades extend outwardly from said motor housing rotating portion.

13. A housing assembly for a fan motor, said housing assembly comprising:

a body comprising a rotatable first body portion and a stationary second body portion, said first body portion rotatably coupled to said second body portion; and a shroud attached against said second body portion and configured to facilitate preventing a negative pressure from developing within said motor housing to prevent moisture from entering said motor housing.

14. A housing assembly in accordance with claim 13 wherein said first body portion is substantially cylindrical and rotates with respect to said second body portion.

15. A housing assembly in accordance with claim 13 wherein said second body portion is substantially cylindrical and is stationary with respect to said first body portion.

16. A housing assembly in accordance with claim 13 wherein said first body portion is snap fit to said second body portion.

17. A housing assembly in accordance with claim 13 wherein said body comprises a plurality of openings to permit moisture to drain to the environment.

18. A housing assembly in accordance with claim 17 wherein said plurality of openings disposed within said second body portion.

19. A housing assembly in accordance with claim 18 wherein shroud is attached to said second body portion such that said plurality of openings remain open to the environment.

20. A housing assembly in accordance with claim 13 wherein said shroud is attached to said second body portion.

21. A housing assembly in accordance with claim 13 wherein said shroud mounted substantially co-axially with said body.

22. A housing assembly in accordance with claim 13 wherein said shroud comprises an outer diameter, said second body portion comprises an outer diameter, said shroud outer diameter approximately equal said second body portion outer diameter.

* * * * *

UNITED STATES PATENT AND TRADEMARK OFFICE

CERTIFICATE OF CORRECTION

PATENT NO. : 6,443,714 B1
DATED : September 3, 2002
INVENTOR(S) : Hollenbeck et al.

It is certified that error appears in the above-identified patent and that said Letters Patent is hereby corrected as shown below:

Column 5,
Line 11, after "wherein" insert -- said --.

Signed and Sealed this

Nineteenth Day of October, 2004

JON W. DUDAS
*Director of the United States Patent and Trademark Office*